US009706288B2

(12) United States Patent
Terlizzi

(10) Patent No.: US 9,706,288 B2
(45) Date of Patent: Jul. 11, 2017

(54) APPARATUS AND METHOD OF ACTIVE NOISE CANCELLATION IN A PERSONAL LISTENING DEVICE

(71) Applicant: Apple Inc., Cupertino, CA (US)

(72) Inventor: Jeffrey Terlizzi, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 150 days.

(21) Appl. No.: 14/656,443

(22) Filed: Mar. 12, 2015

(65) Prior Publication Data

US 2016/0267898 A1 Sep. 15, 2016

(51) Int. Cl.

*G10K 11/16* (2006.01)
*H04R 1/10* (2006.01)
*G10K 11/178* (2006.01)

(52) U.S. Cl.

CPC ..... *H04R 1/1091* (2013.01); *G10K 11/178* (2013.01); *H04R 1/1083* (2013.01); (Continued)

(58) Field of Classification Search

CPC ..... G10K 11/178; G10K 2210/1081; G10K 2210/129; G10K 2210/3226; H04R 1/1083; H04R 1/1091; H04R 2460/01 (Continued)

(56) References Cited

U.S. PATENT DOCUMENTS 8,285,344 B2 10/2012 Kahn et al.
8,320,578 B2 11/2012 Kahn et al.
(Continued)

FOREIGN PATENT DOCUMENTS

EP 2779685 9/2014
EP 2779689 9/2014
(Continued)

OTHER PUBLICATIONS

PCT International Search Report and Written Opinion of the International Searching Authority for PCT Application No. PCT/US2016/018806, mailed Jun. 22, 2016, 12 pages.

*Primary Examiner* — Vivian Chin
*Assistant Examiner* — Friedrich W Fahnert
(74) *Attorney, Agent, or Firm* — Blakely, Sokoloff, Taylor & Zafman LLP

(57) ABSTRACT

Personal listening device (PLD) includes earphone housing having therein (a) inertial sensor to detect motion of PLD and to generate motion signal, (b) pressure sensor to detect compression of portion of PLD and to generate pressure sensor signal, and (c) speaker to receive anti-noise signal and desired audio signal from electronic device, and active noise control (ANC) system to generate anti-noise signal as being one of first or second anti-noise signal. ANC system includes processor, vibration detector to detect vibration of the PLD based on at least one of motion signal or pressure sensor signal, and ANC anti-noise generator to generate first anti-noise signal when vibrations are not detected by vibration detector, and to generate second anti-noise signal when vibrations are detected by vibration detector. Second anti-noise signal is based on detected vibrations. Processor reconfigures ANC system for ANC anti-noise generator to generate second anti-noise signal. Other embodiments are described.

21 Claims, 5 Drawing Sheets

(52) U.S. Cl.
CPC ..... *G10K 2210/1081* (2013.01); *G10K 2210/129* (2013.01); *G10K 2210/3226* (2013.01); *H04R 2460/01* (2013.01)

(58) Field of Classification Search
USPC ..... 381/71.6, 71.1, 74, 370, 98, 71.11; 702/141
See application file for complete search history.

(56) References Cited

U.S. PATENT DOCUMENTS

| | | | | |
|---|---|---|---|---|
| 2009/0082994 | A1 | 3/2009 | Schuler | |
| 2009/0132197 | A1* | 5/2009 | Rubin | H04M 1/72563 702/141 |
| 2012/0140943 | A1* | 6/2012 | Hendrix | G10K 11/1782 381/71.11 |
| 2013/0039507 | A1* | 2/2013 | Park | G10K 11/1788 381/71.6 |
| 2014/0056459 | A1* | 2/2014 | Oishi | H04R 31/00 381/370 |
| 2014/0146976 | A1 | 5/2014 | Rundle | |
| 2014/0314245 | A1* | 10/2014 | Asada | G10K 11/1788 381/71.6 |

FOREIGN PATENT DOCUMENTS

| | | | |
|---|---|---|---|
| WO | 00/35243 | A2 | 6/2000 |
| WO | WO-2013022981 | | 2/2013 |

* cited by examiner

APPARATUS AND METHOD OF ACTIVE NOISE CANCELLATION IN A PERSONAL LISTENING DEVICE

FIELD

Embodiments of the invention relate generally to an apparatus and a method that improve the active noise control (ANC) in a personal listening device (PLD) by reducing artifacts generated by the ANC system in the noise-cancelling control signal when vibrations of the personal listening device are detected. More specifically, an embodiment of the invention is directed to a personal listening device having an active noise control (ANC) system that detects vibrations of the personal listening device and reduces the artifacts generated by the ANC system by reconfiguring the ANC system to generate an anti-noise signal that is based on the detected vibration.

BACKGROUND

Currently, some personal listening devices such as earbuds, earphones, and headphones include an active noise control (ANC), also referred to as acoustic noise cancellation, system that improves the listening experience for the user by cancelling the external or ambient (environmental) noises from being heard by the user. The ANC technique cancels the external or ambient sound by generating a control signal that causes the personal listening device to introduce an anti-noise, which is an additional, electronically controlled sound field designed to counteract or destructively interfere with the desired external or ambient sound.

In some ANC systems, a reference microphone included in the personal listening device (PLD) may be used to pick up the primary noise source and to generate a reference signal. In some ANC systems, an error microphone also coupled to the personal listening device (PLD) may be used to detect the unwanted noise being heard by the user and to generate an error signal that represents the residual noise that may still remain despite the ANC system being in operation. The error signal monitors the ANC system's performance. The reference signal and the error signal may then be used to control the adaptation of the filters in the ANC system.

However, personal listening devices that perform ANC often have issues performing the ANC in a stable manner. For instance, when using the personal listening device while walking, running, or being on a slightly rough bus ride, the sound field captured by the reference microphone and the error microphone may vary substantially from the unwanted ambient noise that is to be cancelled. As a result, the adaptive filters converge to a wrong solution and the anti-noise being generated in accordance with this incorrect solution may include audible artifacts that can be significant enough to cause the user to feel uncomfortable or even nauseous.

SUMMARY

Generally, the invention relates to personal listening devices such as headphones (e.g., earphones, earbuds) that are part of an active noise control (ANC) system to generate an acoustic anti-noise signal that is driving a speaker in the headphone. Specifically, an embodiment of the invention pertains to improving the ANC of the personal listening devices by using signals from an accelerometer and/or signals from a pressure sensor included in the personal listening device (e.g., within an earphone housing) to detect vibrations in the personal listening device and adapting the ANC system to generate an anti-noise signal based on the detected vibrations.

In one embodiment of the invention, a personal listening device (PLD) includes an earphone/headphone housing having therein a speaker, an error microphone, an inertial sensor, and a pressure sensor. The PLD also includes an active noise control (ANC) system. The inertial sensor may detect motion of the PLD and generate a motion signal. The pressure sensor may detect compression of a portion of the PLD and generate pressure sensor signal. The speaker may receive an anti-noise signal and a desired audio signal from an electronic device. The ANC system may generate one of a first anti-noise signal or a second anti-noise signal to drive the speaker and hence, reduce the ambient sound that may be heard by a user of the PLD. The ANC system may include a processor, a vibration detector to detect a vibration of the PLD based on at least one of the motion signal or the pressure sensor signal, and an ANC adaptive anti-noise generator. The ANC adaptive anti-noise generator may generate the first anti-noise signal when vibrations are not detected. The ANC system may generate, when vibrations are detected, the second anti-noise signal based on detected vibrations. In one embodiment, the processor reconfigures the ANC system for the ANC anti-noise generator to generate the second anti-noise.

In another embodiment of the invention, a method of active noise cancellation in a PLD starts with an active noise control (ANC) system receiving a reference microphone acoustic signal and an error microphone acoustic signal from the PLD. The ANC system then receives at least one of a motion signal or a pressure sensor signal from the PLD. The motion signal is based on a detected motion of the PLD and the pressure sensor signal is based on a detected compression of a portion of the PLD. The ANC system then determines whether vibrations of the PLD are detected based on at least one of the motion signal or the pressure sensor signal. When vibrations are not detected, the ANC system generates a first anti-noise signal based on the reference microphone acoustic signal and the error microphone acoustic signal and when vibrations are detected, the ANC system generates a second anti-noise signal. The second anti-noise signal may be based on the detected vibration. The ANC system generating the second anti-noise signal includes reconfiguring the ANC system.

In another embodiment, a computer-readable storage medium has stored therein instructions that, when executed by a processor, causes an active noise control (ANC) system to perform a method of active noise cancellation in a PLD. The method starts with the ANC system receiving a reference microphone acoustic signal and an error microphone acoustic signal from the PLD. The ANC system then receives at least one of a motion signal or a pressure sensor signal from the PLD. The motion signal is based on a detected motion of the PLD and the pressure sensor signal is based on a detected compression of a portion of the PLD. The ANC system then determines whether vibrations of the PLD are detected based on at least one of the motion signal or the pressure sensor signal. When vibrations are not detected, the ANC system generates a first anti-noise signal based on the reference microphone acoustic signal and the error microphone acoustic signal. When vibrations are detected, the ANC system generates a second anti-noise signal, wherein the processor reconfigures the ANC system to generate the second anti-noise signal.

The above summary does not include an exhaustive list of all aspects of the present invention. It is contemplated that the invention includes all systems, apparatuses and methods that can be practiced from all suitable combinations of the various aspects summarized above, as well as those disclosed in the Detailed Description below and particularly pointed out in the claims filed with the application. Such combinations may have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. In the drawings.

DETAILED DESCRIPTION

In the following description, numerous specific details are set forth. However, it is understood that embodiments of the invention may be practiced without these specific details. In other instances, well-known circuits, structures, and techniques have not been shown to avoid obscuring the understanding of this description.

Figure 1:
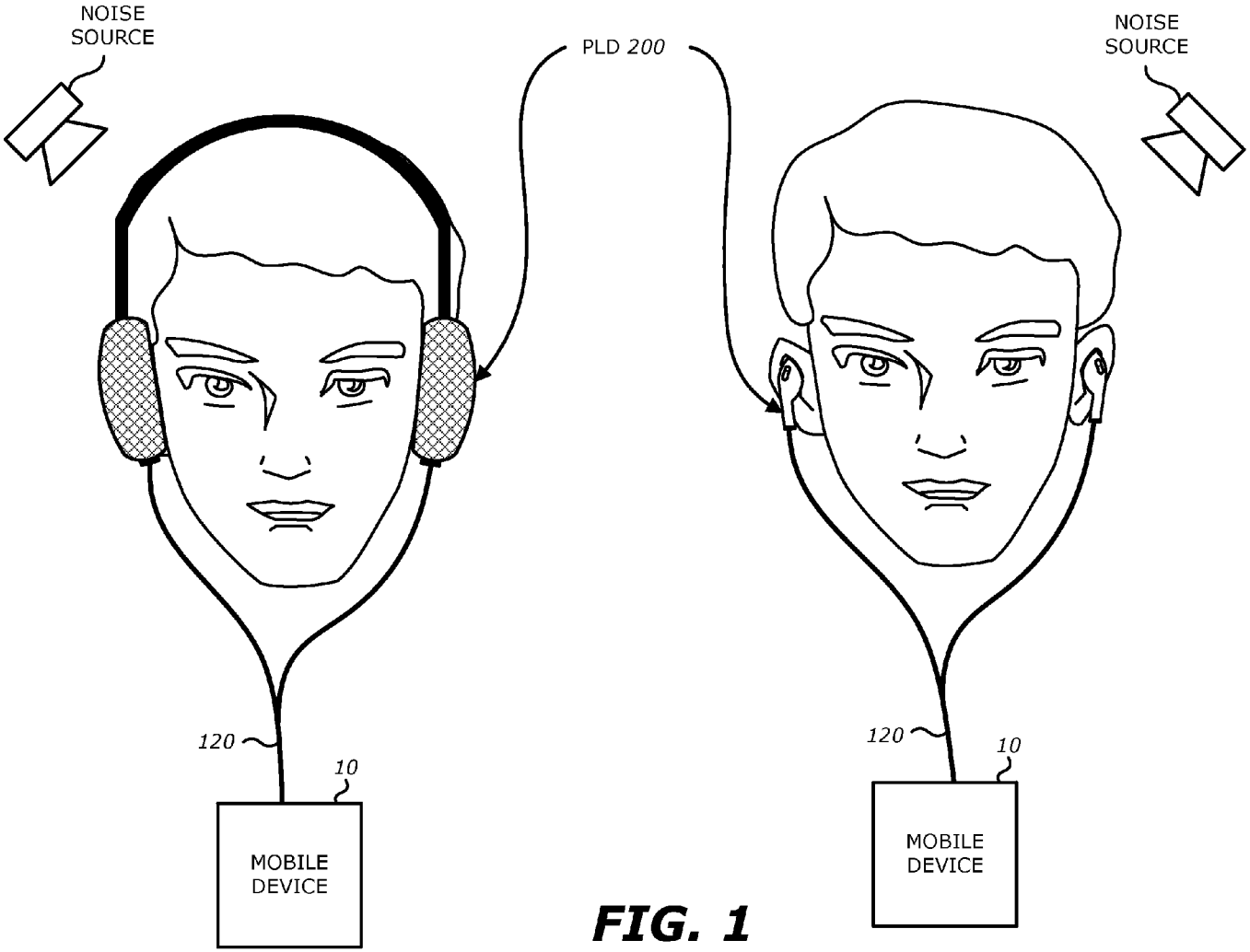
FIG. 1 illustrates examples of personal listening devices that may be coupled with a consumer electronic device according to one embodiment of the invention.

FIG. 1 illustrates an example of personal listening devices (PLD) 200 that may be coupled with a consumer electronic device according to one embodiment of the invention. The personal listening devices may be, for instance, a headphone, an earphone, or a pair of earbuds. The personal listening device 200 may also be closed (or sealed) headphone, earphone, or pair of earbuds such that the speaker opening of the personal listening device 200 is "sealed" by the contact of the ear to the device 200 housing at the region surrounding the speaker's opening. The personal listening device 200 may also be a loosely fitting earbuds.

As shown in FIG. 1, the personal listening device 200 may be a headphone 200 (left) that include a pair of earcups that are placed over the user's ears or may be a pair of earbuds 200 (right) that are placed inside the user's ears. Embodiments of the invention may also use other types of personal listening devices 200. The personal listening device 200 may be coupled to an electronic device 10 that transmits audio signal to the personal listening device 200. The electronic device 10 may be a mobile or a stationary personal consumer electronic device. The personal listening device 200 may be coupled to the electronic device 10 via a wire 120 as shown in FIG. 1 or via wireless connections (not shown). The personal listening devices 200 in FIG. 1 are double-earpiece headsets. It is understood that single-earpiece or monaural headsets may also be used. As the user is using the personal listening device to listen to audio signals from the electronic device 10, environmental noise may also be present (e.g., noise sources in FIG. 1).

Figure 2:
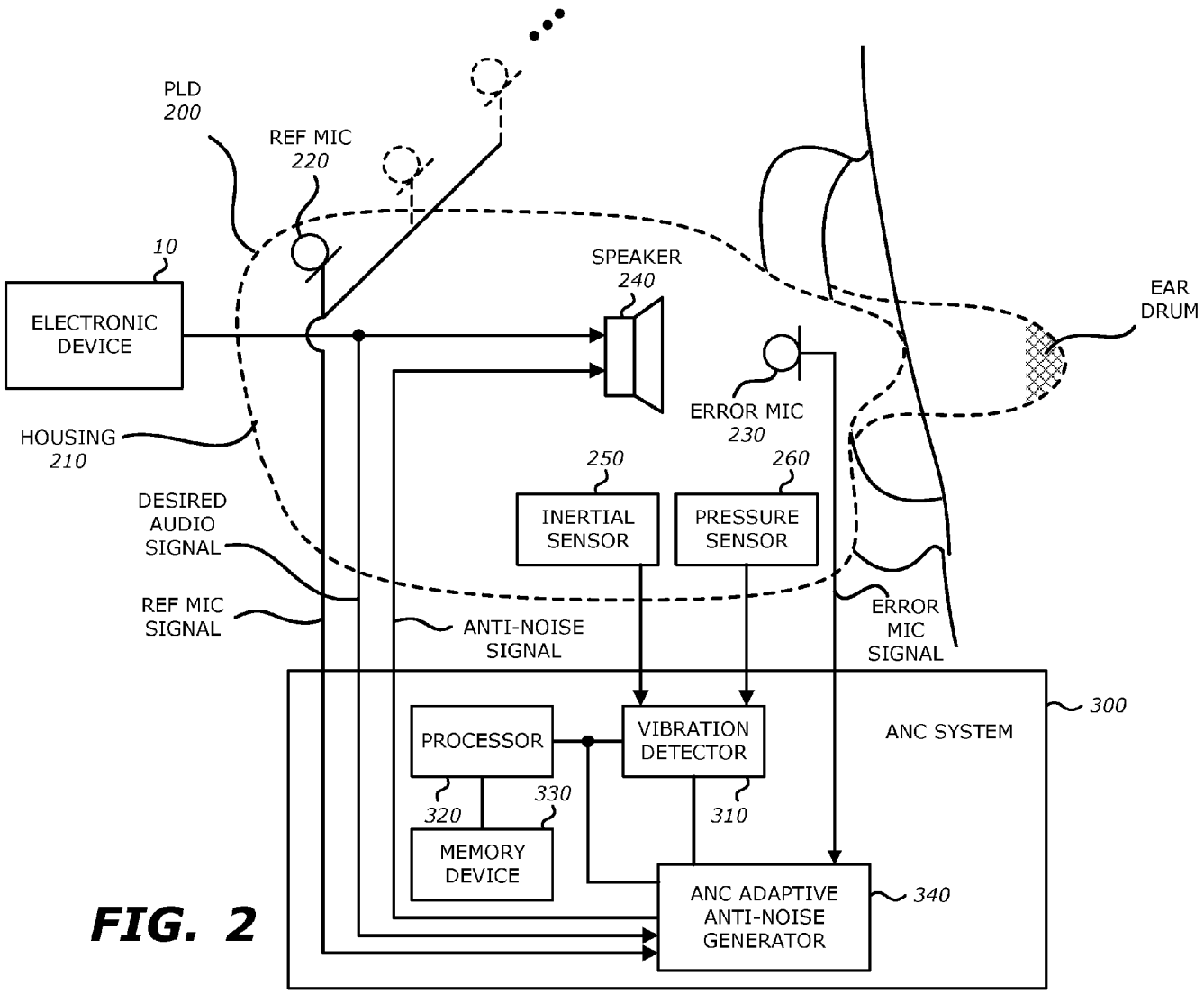
FIG. 2 illustrates an exemplary system for active noise cancellation in a personal listening device according to one embodiment of the invention.

FIG. 2 illustrates an exemplary system for active noise cancellation in a personal listening device according to one embodiment of the invention. The system in FIG. 2 illustrates an electronic device 10 used with an example of the right side of a personal listening device 200 according to one embodiment of the invention. It is understood that a similar configuration may be included in the left side of the personal listening device 200. FIG. 2 also includes an active noise control (ANC) system 300 that generates the anti-noise signal that is outputted by a speaker 240. While illustrated as being separate in FIG. 2, the ANC system 300 may be included in the personal listening device 200's housing 210 according to one embodiment. In another embodiment, the ANC system 300 may be included in the electronic device 10.

Referring to FIG. 2, the personal listening device 200 comprises a housing 210 that has installed therein at least one reference microphone 220, an error microphone 230, a speaker 240, an inertial sensor 250, and a pressure sensor 260. The housing 210 may be an earphone housing. The reference microphone 220 and the error microphone 230 may be air interface sound pickup devices that convert sound into an electrical signal. In one embodiment, the reference microphone 220 is located within the housing 210. The reference microphone 220 may be located behind the speaker 240 as shown to pick up primary noise (e.g., external noise, ambient noise, environmental noise, voice, etc.) that is external to the personal listening device 200 and that may be heard by a user of the personal listening device 200. In some embodiments, the reference microphone 220 is installed on the exterior of the housing 210 such that the reference microphone 220 is mounted externally to the personal listening device 200 to pick up the primary noise. In one embodiment, the reference microphone 220 is mounted on the bridge or headband portion of a headphone. As shown in FIG. 2, the reference microphone 220 may face the opposite direction of the eardrum. In the embodiment where a plurality of reference microphones 220 are included in the personal listening device 200, the plurality of reference microphones 220 can form one or more microphone arrays that may be used to create microphone array beams (i.e., beamformers) which can be steered to a given direction by emphasizing and deemphasizing selected microphones 220. In one embodiment, the beamformers may be steered towards the primary noise source. Similarly, the microphone arrays can also exhibit or provide nulls in other given directions. Accordingly, the beamforming process, also referred to as spatial filtering, may be a signal processing technique using the microphone array for directional sound reception. The reference microphone 220 generates and transmits a reference signal to the ANC system 300.

As shown in FIG. 2, the speaker 240 receives the desired audio signal (e.g., desired audio content) from the electronic device 10 and generates the desired audio signal for the user of the personal listening device 200. The speaker 240 also receives an anti-noise signal from the ANC system 300. The speaker 240 outputs the anti-noise signal which is a signal that cancels the environmental noise from the audio signal heard by the user of the personal listening device 200.

As shown in FIG. 2, the error microphone 230 is located in front of the speaker 240 at a position that is closest to the user's canal. The error microphone faces away from the direction of the user's eardrum. Accordingly, the error microphone 230 receives the acoustic signals that are outputted by the speaker 240 which are heard by the user of the personal listening device 200. The acoustic signals that are outputted by the speaker 240 may include unwanted noise that was not cancelled by the ANC system 300. The error microphone 230 thus monitors the performance of the ANC system 300 by detecting the unwanted noise and generating and transmitting an error signal to the ANC system 300. The unwanted noise may be due to the frequency response of the overall sound producing system, which includes the electro-acoustic response of the personal listening device 200 and the physical or acoustic features of the user's ear up to the eardrum that can vary substantially during normal end-user operation, as well as across different users. Using the error signal from the error microphone 230, the ANC system 300 may implement an adaptive filtering scheme (e.g., filtered-x least minimum square algorithm (FXLMS)).

The inertial sensor 250 included in the personal listening device 200 may be a sensing device that measures proper acceleration in three directions, X, Y, and Z or in only one or two directions. For example, the inertial sensor 250 may be an accelerometer, a gyroscope, or microelectromechanical system (MEMS). In other embodiments, a force sensor or a position, orientation and movement sensor may be used in lieu of the inertial sensor 250. In one embodiment, the inertial sensor 250 detects motion of the PLD and generates a motion signal that is transmitted to the ANC system 300. For instance, when the user of the personal listening device 200 walks, runs, jumps or is on a rough or bumpy ride in a vehicle, the inertial sensor 250 may detect the vibrations of the personal listening device 200.

The pressure sensor 260 included in the personal listening device 200 may be a sensing device that measures the compression of a portion of the personal listening device 200 and to generate pressure sensor signal. The pressure sensor 260 may be an optical pressure sensor, a capacitive pressure sensor, a piezoelectric pressure sensor, an electromagnetic pressure sensor, etc. In one embodiment, the earpad portion of the personal listening device 200 may be made of a soft material (e.g., soft leather, semi-leather, special urethane, etc.). When the user of the personal listening device 200 walks, runs, or is on a rough or bumpy ride in a vehicle, the earpad portion of the personal listening device 200 may compress and decompress against the user's ear in accordance with the vibrations of the personal listening device 200. The pressure sensor 260 may detect the compression (and decompression) of the earpad portion, for instance, and generate a pressure sensor signal that is transmitted to the ANC system 300. In one embodiment, the pressure sensor signal may be used to determine whether the personal listening device is vibrating.

As shown in FIG. 2, the ANC system 300 comprises a processor 320, a memory device 330, a vibration detector 310, and an ANC adaptive anti-noise generator 340. The memory device 330, the vibration detector 310 and the ANC adaptive anti-noise generator 340 may be coupled to the processor 320. The memory device 330 may include one or more different types of storage such as hard disk drive storage, nonvolatile memory, and volatile memory such as dynamic random access memory. The processor 320 may be a microprocessor, a microcontroller, a digital signal processor, or a central processing unit. The term "processor" may refer to a device having two or more processing units or elements, e.g. a CPU with multiple processing cores. The processor 320 may be used to control the operations of the ANC system 300 by executing software instructions or code stored in the memory device 330. For instance, the processor 320 may execute software instructions or code stored in the memory device 330 that causes the processor 320 to perform a method for active noise cancellation in the personal listening device 200 according to an embodiment of the invention. The ANC system 300 operates while the user is for example listening to a digital music file that is stored in the electronic device 10.

As shown in FIG. 2, the vibration detector 310 may detect a vibration of the personal listening device 200 based on at least one of the motion signal from the inertial sensor 250 or the pressure sensor signal from the pressure sensor 260. The processor 320 may control the vibration detector 310 by executing software instructions or code stored in the memory device 330 to determine whether vibrations of the personal listening device 200 are detected based on the received motion signal from the inertial sensor 250 and the pressure sensor signal from the pressure sensor 260. In one embodiment, the ANC anti-noise generator 340 generates a first anti-noise signal when vibrations are not detected by the vibration detector 310 and generates a second anti-noise signal when vibrations are detected by the vibration detector 310. The second anti-noise signal may be based on the detected vibrations. In one embodiment, the processor 320 reconfigures the ANC system 300 for the ANC anti-noise generator 340 to generate the second anti-noise signal.

Figure 3:
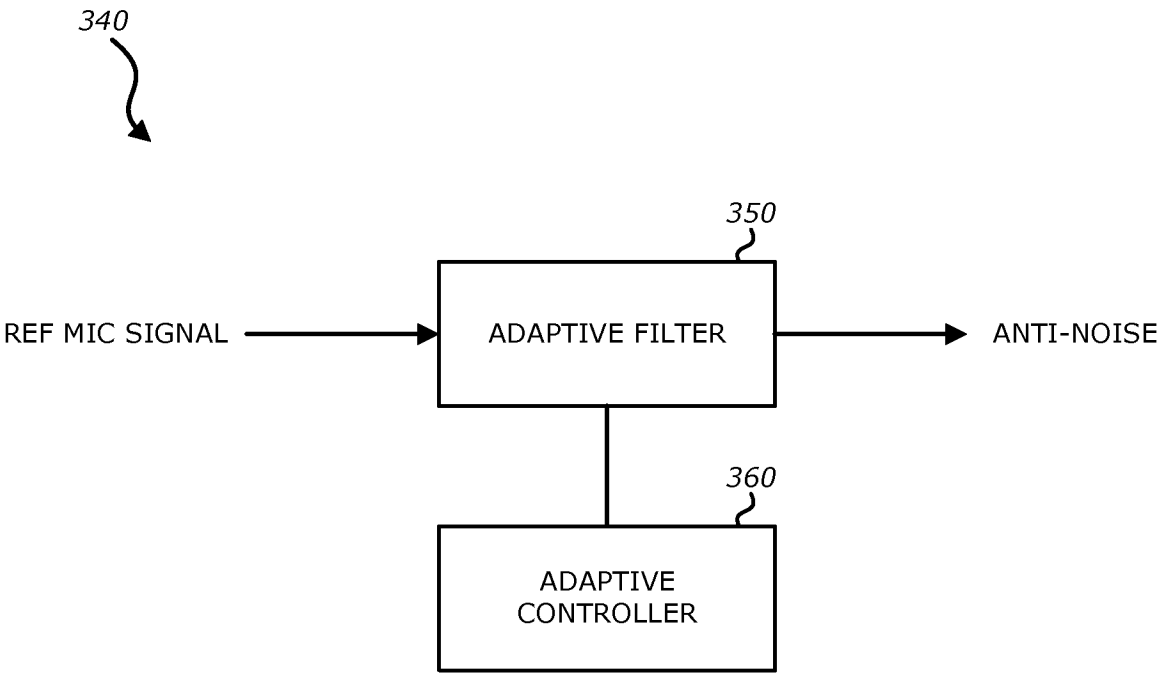
FIG. 3 illustrates a block diagram of the details of an exemplary system for active noise cancellation in a personal listening device according to one embodiment of the invention.

As shown in FIG. 2, the ANC adaptive anti-noise generator 340 receives the reference signal from the reference microphone 220 and the desired audio signal from the electronic device 10. The reference signal may be digitized and processed by the ANC adaptive anti-noise generator 340 to generate the anti-noise signal that is transmitted to the speaker 240 inside the personal listening device 200. FIG. 3 illustrates a block diagram of the details of the ANC adaptive anti-noise generator 340 according to one embodiment of the invention. The ANC adaptive anti-noise generator 340 may include at least one adaptive filter 350 and an adaptive controller 360. As shown in FIG. 3, the at least one adaptive filter 350 receives the reference signal and generates the anti-noise signal that is electronically designed so as to have the proper pressure amplitude and phase that destructively interferes with the unwanted ambient noise captured by the reference microphone 220. The speaker 240 then outputs the anti-noise signal.

The ANC adaptive anti-noise generator 340 also receives the error signal from the error microphone 230 as discussed above that monitors the performance of the ANC system 300. The error signal may be digitized and processed by the ANC adaptive anti-noise generator 340. In the implementation of the adaptive ANC system 300 based on the FXLMS algorithm, an identification of a secondary path is required. Thus, there are two adaptive filters operating simultaneously for each channel, the control filter and the secondary path filter. The identification and/or modeling of the transfer function for the secondary path can be performed online using the downlink (playback) signal as the training signal for the LMS algorithm.

The implementation of an adaptive ANC system 300 based on the FXLMS algorithm also uses the vibration detector 310 to detect when the personal listening device 200 is vibrating. When the personal listening device 200 is vibrating due to the user walking, running, jumping, etc., the reference signal from the reference microphone 220 and the error signal from the error microphone 230 may be inaccurate in that the signals may include the vibration and/or compression of the personal listening device 200 as part of the noise to be cancelled by the ANC system 300. Thus, the signals from the reference microphone 220 and from the error microphone 230 when the personal listening device 200 may act as a disturbance signal to the adaptive filter algorithms, possibly causing the divergence of the filters. Accordingly, the vibration detector 310 is used to determine when the personal listening device 200 is vibrating. When vibrations of the personal listening device 200 are detected, the processor 320 may prevent the corrupted reference signal and the corrupted error signal to be used to adapt the filter(s) 350 in the ANC adaptive anti-noise generator 340 of the ANC system 300. Thus, the at least one adaptive filter 350 is prevented from diverging or becoming unstable. In one embodiment, the ANC adaptive anti-noise generator 34 generates an anti-noise signal based on the reference signal and the error signal when vibrations are not detected. However, when the personal listening device 200 is vibrating, the anti-noise signal that is based on the reference signal and the error signal causes the personal listening device 200 to generate an anti-noise that includes artifacts. Accordingly, when the vibration detector 310 detects vibrations, the ANC adaptive anti-noise generator 340 generates a second anti-noise signal based on detected vibrations.

In one embodiment, the vibration detector 310 receives at least one of the motion signal from the inertial sensor 250 or the pressure sensor signal from the pressure sensor 260. The motion signal and the pressure sensor signal may be digitized and processed by the vibration detector 310 to determine if the personal listening device 200 is vibrating. In one embodiment, the memory device 330 stores a plurality of predetermined sensor data patterns including patterns that indicate the contexts of: walking, jumping, running, and vehicle motions or vibrations. In this embodiment, the vibration detector 310 establishes that vibrations of the personal listening device 200 are detected when the vibration detector 310 matches at least one of the motion signal or the pressure sensor signal with at least one of the predetermined sensor data patterns.

In one embodiment, when the vibration detector 310 detects vibrations, the processor 320 reconfigures the ANC system 300 for the ANC anti-noise generator 340 to generate the second anti-noise based on the detected vibrations. The processor 320 in the ANC system 300 may implement a feed forward, a feedback, or a hybrid noise control algorithm. The processor 320 may reconfigure the ANC system 300 by for example adapting the coefficients of an finite impulse response (FIR) filter (e.g., secondary path) using a LMS adaptive algorithm, adapting the coefficients of an FIR filter (e.g., the control filter path) according to a filtered-x LMS algorithm, and reconfigure the ANC system 300 to alter the adaptation of the FIR filters when vibration of the personal listening device 200 is detected. For instance, when vibrations are detected, the processor 320 may lock the filter coefficients of an adaptive filter 350 included in the ANC system 300 or the processor may alternatively lock filtering by the adaptive filter 350. The locking of the filter coefficients or the locking of the filtering may also be referred to as "freezing" the adaptive filter. Accordingly, the adaptive filter 350 remains in a previously acceptable state (e.g., not diverging or unstable) and generates anti-noise signals. In another embodiment, to reconfigure the ANC system 300, the processor 320 changes a speed of updates made to the adaptive filter 350 by the adaptive filter controller 360 included in the ANC system 300. For instance, if the vibration detector 310 matches the motion signal or the pressure signal with the predetermined sensor data pattern associated with the context of walking, the processor 320 may increase the speed of the adaptive filter updates in between the steps and may slowdown the speed of the adaptive filter updates when the user's step occurs (e.g., when the user's foot hits the ground). Accordingly, the ANC system 300 accounts for the pressure level change in the earcup due to the user's steps affecting the reference microphone signal from the reference microphone 220. In another embodiment, to reconfigure the ANC system 300 when vibrations are detected, the processor 320 selects predetermined adaptive filter coefficients associated with the at least one of the predetermined sensor data patterns. For instance, if the vibration detector 310 matches the motion signal or the pressure signal with the predetermined sensor data pattern associated with the context of walking, the processor 320 may select the predetermined adaptive filter coefficient associated with the context of walking. The predetermined adaptive filter coefficients associated with each of the contexts may be stored in the memory device 330. In this embodiment, the processor 320 overrides the filter coefficients of the adaptive filter 350, that were computed by the adaptive filter controller 360 included in the ANC system 300, with the predetermined filter coefficients that were selected. In another embodiment, to reconfigure the ANC system 300 when vibrations are detected, the processor 320 applies a jacket on filter coefficients of an adaptive filter 350 included in the ANC system 300. The jacket establishes a maximum and a minimum for desired filter coefficients. Accordingly, when the vibrations of the personal listening device 200 cause the adaptive filter controller 360 to generate erroneous coefficients for the adaptive filter 350 in the ANC system 300, the processor 320 applies the jacket to the erroneous coefficients which causes the erroneous coefficients that exceed the maximum established by the jacket or that fall below the minimum established by the jacket to be corrected by the processor 320. The corrected values of the coefficients are values that are within the jacket's established limits. In one embodiment, when vibrations are detected, the processor 320 may mute the anti-noise signal output from the speaker 240. However, it is noted that muting the anti-noise signal when the vibrations are detected in the personal listening device 200 may introduce artifacts in the acoustic signal being heard by the user.

Moreover, the following embodiments of the invention may be described as a process, which is usually depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a procedure, etc.

Figure 4:
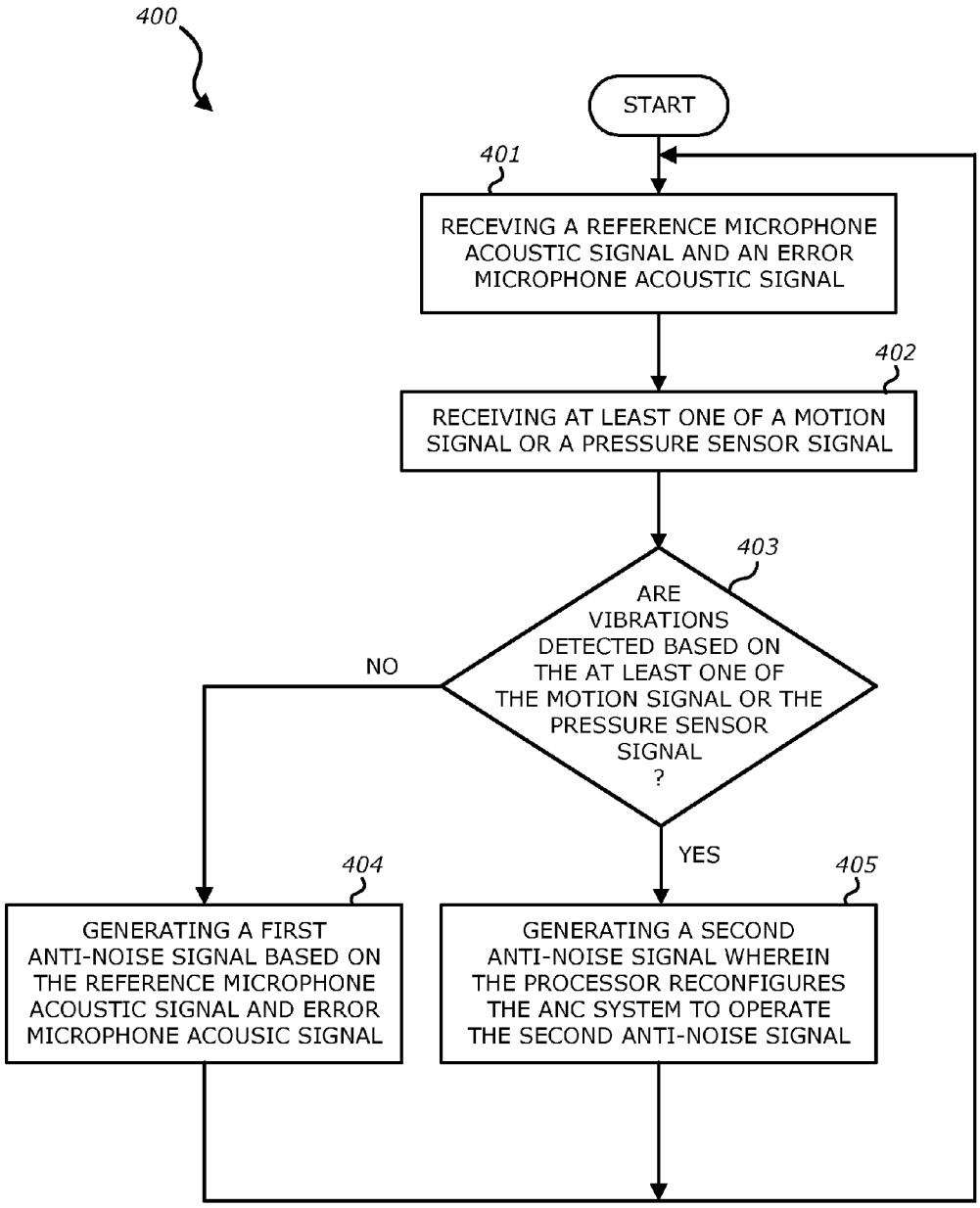
FIG. 4 illustrates a flow diagram of an example method for active noise cancellation in a personal listening device according to one embodiment of the invention.

FIG. 4 illustrates a flow diagram of an example method of improving active noise cancellation in a personal listening device according to one embodiment of the invention. The method 400 in FIG. 4 starts with the ANC system 300 receiving a reference microphone acoustic signal and an error microphone acoustic signal from the personal listening device 200 at Block 401. At Block 402, the ANC system 300 receives at least one of a motion signal or a pressure sensor signal from the personal listening device 200. The motion signal is based on a detected motion of the personal listening device and the pressure sensor signal is based on a detected compression of a portion of the personal listening device 200. At Block 403, the ANC system 300 determines whether vibrations of the personal listening device are detected based on at least one of the motion signal or the pressure sensor signal. If at Block 403, the ANC system 300 determines that vibrations are not detected, the method 400 continues to Block 404 and the ANC system generates a first anti-noise signal that is based on the reference microphone acoustic signal and the error microphone acoustic signal. If at Block 403, the ANC system 300 determines that vibrations are detected, the method 400 continues to Block 405 and the ANC system 300 generates a second anti-noise signal. The second anti-noise signal may be based on the detected vibration. In one embodiment, the ANC system 300 is reconfigured by the processor 320 to generate the second anti-noise signal at Block 405.

Figure 5:
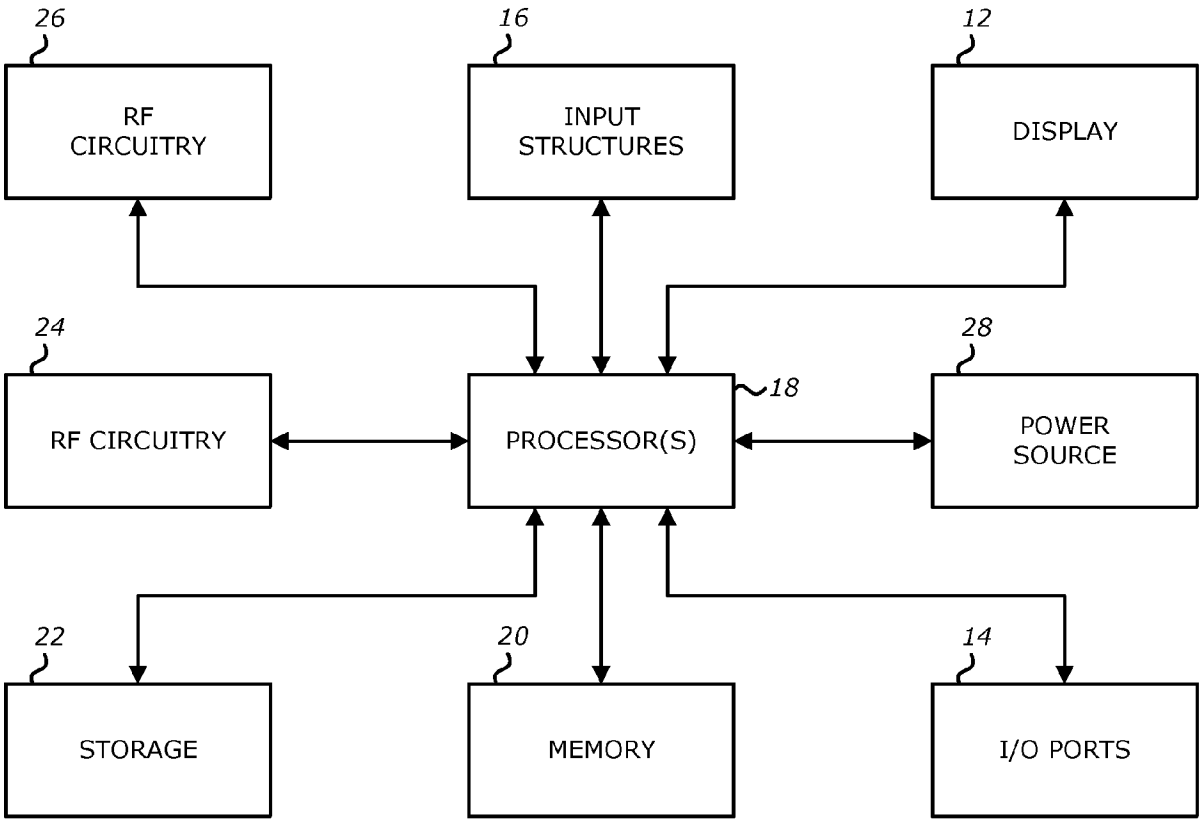
FIG. 5 is a block diagram of exemplary components of an electronic device used with a personal listening device in accordance with aspects of the present disclosure.

A general description of suitable electronic devices for performing these functions is provided below with respect to FIG. 5. Specifically, FIG. 5 is a block diagram depicting various components that may be present in electronic devices suitable for use with the present techniques. An example of a suitable electronic device includes a computer, a handheld portable electronic device, a tablet-style electronic device, etc. These types of electronic devices, as well as other electronic devices providing comparable voice communications capabilities (e.g., VoIP, telephone communications, etc.), may be used in conjunction with the present techniques.

Keeping the above points in mind, FIG. 5 is a block diagram illustrating components that may be present in one such electronic device 10, and which may allow the device 10 to function in accordance with the techniques discussed herein. The various functional blocks shown in FIG. 5 may include hardware elements (including circuitry), software elements (including computer code stored on a computer-readable medium, such as a hard drive or system memory), or a combination of both hardware and software elements. It should be noted that FIG. 5 is merely one example of a particular implementation and is merely intended to illustrate the types of components that may be present in the electronic device 10. For example, in the illustrated embodiment, these components may include a display 12, input/output (I/O) ports 14, input structures 16, one or more processors 18, memory device(s) 20, non-volatile storage 22, expansion card(s) 24, RF circuitry 26, and power source 28.

While the invention has been described in terms of several embodiments, those of ordinary skill in the art will recognize that the invention is not limited to the embodiments described, but can be practiced with modification and alteration within the spirit and scope of the appended claims. The description is thus to be regarded as illustrative instead of limiting. There are numerous other variations to different aspects of the invention described above, which in the interest of conciseness have not been provided in detail. Accordingly, other embodiments are within the scope of the claims.

The invention claimed is:

1. A personal listening device (PLD) comprising:

an earphone housing having therein (a) an inertial sensor to detect motion of the PLD and to generate a motion signal, (b) a pressure sensor to detect compression of a portion of the PLD and to generate pressure sensor signal, and (c) a speaker to receive an anti-noise signal and a desired audio signal from an electronic device; and an active noise control (ANC) system to generate the anti-noise signal as being one of a first anti-noise signal or a second anti-noise signal, the ANC system includes a processor, a vibration detector coupled to the processor, the vibration detector to detect a vibration of the PLD based on at least one of the motion signal or the pressure sensor signal, and an ANC anti-noise generator coupled to the processor, the ANC anti-noise generator to generate the first anti-noise signal when vibrations are not detected by the vibration detector, and to generate the second anti-noise signal when vibrations are detected by the vibration detector, the second anti-noise signal being based on detected vibrations, wherein the processor reconfigures the ANC system for the ANC anti-noise generator to generate the second anti-noise signal.

2. The PLD in claim 1, wherein the inertial sensor comprises at least one of an accelerometer, a gyroscope, or a microelectromechanical system (MEMS), wherein the inertial sensor detects motion in at least three axes: x-axis, y-axis, z-axis.

3. The PLD in claim 1, wherein the first anti-noise signal is based on at least one of a reference microphone signal or an error microphone signal.

4. The PLD in claim 3, wherein the ANC system comprises a memory device:

to store a plurality of predetermined sensor data patterns including patterns that indicate the contexts of: walking, jumping, running, and vehicle motions or vibrations.

5. The PLD in claim 4, wherein the vibration detector is coupled to the memory device and wherein the vibration detector to detect the vibration comprises:

the vibration detector matching at least one of the motion signal or the pressure sensor signal with at least one of the predetermined sensor data patterns.

6. The PLD of claim 5, wherein the processor reconfiguring the ANC system comprises:

the processor locking filter coefficients of an adaptive filter included in the ANC system or locking filtering by the adaptive filter included in the ANC system.

7. The PLD of claim 5, wherein the processor reconfiguring the ANC system comprises:

the processor changing a speed of updates made to an adaptive filter by an adaptive filter controller included in the ANC system.

8. The PLD of claim 5, wherein the processor reconfiguring the ANC system comprises:

the processor selecting predetermined adaptive filter coefficients associated with the at least one of the predetermined sensor data patterns, wherein the predetermined coefficients are stored in the memory device, and the processor overriding filter coefficients of an adaptive filter, that were computed by an adaptive filter controller included in the ANC system, with the predetermined filter coefficients.

9. The PLD of claim 5, wherein the processor reconfiguring the ANC system comprises:

the processor applying a jacket on filter coefficients of an adaptive filter included in the ANC system.

10. The PLD of claim 5, wherein the processor reconfiguring the ANC system comprises:

the processor muting the anti-noise signal output from the speaker.

11. A method of active noise cancellation in a personal listening device (PLD) comprising:

receiving by an active noise control (ANC) system a reference microphone acoustic signal and an error microphone acoustic signal from the PLD;

receiving by the ANC system at least one of a motion signal or a pressure sensor signal from the PLD, wherein the motion signal is based on a detected motion of the PLD and the pressure sensor signal is based on a detected compression of a portion of the PLD;

determining by the ANC system whether vibrations of the PLD are detected based on at least one of the motion signal or the pressure sensor signal;

when vibrations are not detected, generating by the ANC system a first anti-noise signal based on the reference microphone acoustic signal and the error microphone acoustic signal; and when vibrations are detected, generating by the ANC system a second anti-noise signal, wherein generating by the ANC system the second anti-noise signal includes reconfiguring the ANC system.

12. The method of claim 11, wherein determining by the ANC system whether vibrations of the PLD system are detected comprises:

the ANC system matching at least one of the motion signal or the pressure sensor signal with at least one of a plurality of predetermined sensor data patterns.

13. The method of claim 12, wherein the plurality of predetermined sensor data patterns are stored in a memory device included in the ANC system.

14. The method of claim 13, wherein the plurality of predetermined sensor data patterns include patterns that indicate the contexts of walking, jumping, running, and vehicle motions or vibrations.

15. The method of claim 14, wherein reconfiguring the ANC system comprises:

locking filter coefficients of an adaptive filter included in the ANC system.

16. The method of claim 14, wherein reconfiguring the ANC system comprises:

changing a speed of updates made to an adaptive filter by an adaptive filter controller included in the ANC system.

17. The method of claim 14, wherein reconfiguring the ANC system comprises:

selecting predetermined adaptive filter coefficients associated with the at least one of the predetermined sensor data patterns, wherein the predetermined coefficients are stored in the memory device, and a processor overriding filter coefficients of an adaptive filter, that were computed by an adaptive filter controller included in the ANC system, with the predetermined filter coefficients.

18. The method of claim 14, wherein reconfiguring the ANC system comprises:

a processor applying a jacket on filter coefficients of an adaptive filter included in the ANC system.

19. A computer-readable non-transitory storage medium having stored therein instructions, when executed by a processor, causes an active noise control (ANC) system to perform a method of active noise cancellation in a personal listening device (PLD), the method comprising: receiving a reference microphone acoustic signal and an error microphone acoustic signal from the PLD; receiving at least one of a motion signal or a pressure sensor signal from the PLD, wherein the motion signal is based on a detected motion of the PLD and the pressure sensor signal is based on a detected compression of a portion of the PLD; determining whether vibrations of the PLD are detected based on at least one of the motion signal or the pressure sensor signal; when vibrations are not detected, generating a first anti-noise signal based on the reference microphone acoustic signal and the error microphone acoustic signal; and when vibrations are detected, generating a second anti-noise signal, wherein the processor reconfigures the ANC system to generate the second anti-noise signal.

20. The computer-readable non-transitory storage medium of claim 19, wherein the ANC system is included in an electronic device coupled to the PDL, the electronic device transmitting an audio signal to the PDL.

21. The computer-readable non-transitory storage medium of claim 19, wherein the ANC system is included in the PDL.

* * * * *